US012390057B2

(12) United States Patent
Tramontina et al.

(10) Patent No.: US 12,390,057 B2
(45) Date of Patent: Aug. 19, 2025

(54) MOTOR DRIVEN SPINDLE ASSEMBLY FOR A DISPENSER

(71) Applicant: Kimberly-Clark Worldwide, Inc., Neenah, WI (US)

(72) Inventors: Paul F. Tramontina, Harleysville, PA (US); Charles A. Osborne, Jr., Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 142 days.

(21) Appl. No.: 18/263,354

(22) PCT Filed: Mar. 10, 2021

(86) PCT No.: PCT/US2021/021711

§ 371 (c)(1),
(2) Date: Jul. 28, 2023

(87) PCT Pub. No.: WO2022/191835

PCT Pub. Date: Sep. 15, 2022

(65) Prior Publication Data

US 2024/0298850 A1 Sep. 12, 2024

(51) Int. Cl.
*A47K 10/36* (2006.01)

(52) U.S. Cl.
CPC ..... *A47K 10/3612* (2013.01)

(58) Field of Classification Search
None
See application file for complete search history.

(56) References Cited

U.S. PATENT DOCUMENTS 3,473,749 A 10/1969 Rogers
3,667,825 A * 6/1972 Pagel ..... A47K 10/3612 242/564.2
6,895,848 B1 5/2005 Svensson
(Continued)

FOREIGN PATENT DOCUMENTS

CN 2621172 Y 6/2004
CN 2707172 Y 7/2005
WO WO2018170219 A1 9/2018

OTHER PUBLICATIONS

PCT Search Report Corresponding to Application No. PCT/US2021/021711 on Jun. 21, 2021.
(Continued)

*Primary Examiner* — William A. Rivera
(74) *Attorney, Agent, or Firm* — Dority & Manning, P.A.

(57) ABSTRACT

A motor driven spindle assembly for a dispenser includes a spindle that defines an interior volume. A motor is disposed within the interior volume of the spindle and is operable to rotate the spindle. A bracket includes a plate, a first leg, and a second leg. The plate of the bracket is positioned within the interior volume of the spindle. Proximal end portions of the first and second legs are positioned at the plate. A distal end portion of the first leg is positioned within a first opening of a bushing such that the distal end portion of the first leg is slidable within the first opening along a lateral direction. A distal end portion of the second leg is positioned within a second opening of the bushing such that the distal end portion of the second leg is slidable within the second opening along the lateral direction.

17 Claims, 8 Drawing Sheets

(56) References Cited

U.S. PATENT DOCUMENTS

| | | | | |
|---|---|---|---|---|
| 8,082,827 | B2 | 12/2011 | Friesen et al. | |
| 8,496,198 | B2 | 7/2013 | Cittadino et al. | |
| 10,149,583 | B2 | 12/2018 | Vuylsteke et al. | |
| 10,602,889 | B2 | 3/2020 | Paul | |
| 10,660,486 | B2 | 5/2020 | Osborne, Jr. | |
| 10,738,866 | B2 | 8/2020 | Nunez et al. | |
| 12,275,608 | B2 * | 4/2025 | Bertram | B65H 23/182 |
| 2007/0257147 | A1 * | 11/2007 | Kanbar | B65H 35/0066 242/564.4 |
| 2011/0068129 | A1 | 3/2011 | Maurer | |
| 2013/0334357 | A1 | 12/2013 | Huruse | |
| 2014/0291437 | A1 * | 10/2014 | Corley | A47K 10/38 242/563 |
| 2018/0263433 | A1 | 9/2018 | Osborne, Jr. | |
| 2018/0263435 | A1 * | 9/2018 | Osborne, Jr. | B65H 26/06 |
| 2019/0330008 | A1 | 10/2019 | Feng | |
| 2020/0305655 | A1 | 10/2020 | Sulik et al. | |
| 2025/0049269 | A1 * | 2/2025 | Osborne, Jr. | A47K 10/3625 |

OTHER PUBLICATIONS

ISL, Design Note: Planetary Gear Motors vs. Spur Gear Motors, https://www.istproducts.com/design-notes/planetary-gear-motors-vs-spur-gear-motors/, 5 pages.

Canadian Office Action Corresponding to Application No. 3,210,835 on Oct. 3, 2023.

* cited by examiner

MOTOR DRIVEN SPINDLE ASSEMBLY FOR A DISPENSER

RELATED APPLICATIONS

The present application is the national stage entry of International Patent Application No. PCT/US2021/021711 having a filing date of Mar. 10, 2021, which is incorporated herein in its entirety by reference thereto.

BACKGROUND

Various dispensers for paper products are known in the art. Certain dispensers include a motor that operates to selectively dispense a paper roll. In response to a user input, such as a hand wave, the motor drives rotation of a spindle engaged with a free end of paper on the paper roll. As the spindle rotates, the spindle may translate the free end of the paper on the paper roll out of the dispenser where the user can tear off the dispensed portion of the paper roll. During operation of the motor to rotate the spindle, the paper roll rotates within the dispenser to maintain engagement between the spindle and the paper on the paper roll and allow subsequent dispensing.

Space within dispensers is occupied by various components, including the motor. In known dispensers, the motor occupies valuable internal space and thus increases the overall dispenser size.

Consistently mounting the motor within known dispensers such that the motor operates reliably can also be difficult. For example, the motor support structure in known dispensers can interfere with the motor and cause the motor to draw excessive current. Thus, during manufacturing, large numbers of dispensers may require time-intensive fine tuning to correctly support the motor within the dispenser and allow proper motor operation.

In view of the above, a need exists for improved dispensers for paper products, including an improved support for a motor within dispenser.

SUMMARY

In general, the present disclosure is directed to a motor driven spindle assembly for a dispenser. The motor driven spindle assembly for a dispenser includes a spindle and a motor. The motor is disposed within the spindle. Thus, the motor driven spindle assembly for a dispenser advantageously occupies a smaller volume within the dispenser, e.g., relative to positioning the motor outside of the spindle. The motor driven spindle assembly also includes a bracket for supporting the motor within the spindle. The bracket also allows for axial movement of the motor relative to the spindle. Thus, the bracket may allow the motor to "float" axially within the spindle, and the bracket may advantageously reduce interference between the motor and the spindle, e.g., relative to known brackets that push the motor against the spindle.

In one example embodiment, a motor driven spindle assembly for a dispenser includes a spindle rotatable about an axis. The spindle extends longitudinally between a first end portion of the spindle and a second end portion of the spindle. The spindle defines an interior volume within the spindle at the first end portion of the spindle. A motor is disposed within the interior volume of the spindle. The motor is operable to rotate the spindle about the axis. A bracket is configured for supporting the motor within the spindle. The bracket includes a plate, a first leg, and a second leg. The plate of the bracket is positioned within the interior volume of the spindle proximate a first end portion of the motor. Each of the first and second legs has a respective proximal end portion and a respective distal end portion. The proximal end portion of the first and second legs are positioned at the plate. Each of the first and second legs extends away from the plate to the distal end portion of the first and second legs. A bushing is positioned proximate a second end portion of the motor. The bushing defines a first opening and a second opening. The distal end portion of the first leg is positioned within the first opening of the bushing such that the distal end portion of the first leg is slidable within the first opening along a lateral direction. The distal end portion of the second leg is positioned within the second opening of the bushing such that the distal end portion of the second leg is slidable within the second opening along the lateral direction. The lateral direction is parallel to the axis.

In a first example aspect, the motor driven spindle assembly may further include a drive gear assembly. The drive gear assembly may include a first gear and a second gear. The first gear may be disposed within the interior volume of the spindle and may be coupled to the spindle. The second gear may be meshed with the first gear and may be coupled a rotor of the motor. The first gear may include a plurality of teeth extending radially inward. The second gear may include a plurality of teeth extending radially outward. The plurality of teeth of the first gear may be meshed with the plurality of teeth of the second gear. The first gear may include a web that extends radially inward from a ring of the first gear. The plurality of teeth of the first gear may be disposed on the ring of the first gear. The second gear may include a web that extends radially inward from a ring of the second gear. The plurality of teeth of the second gear may be disposed on the ring of the second gear. A spacer is disposed between the web of the first gear and the web of the second gear. The rotor of the motor may extend at least partially into the spacer. The spindle may include a plurality of splines disposed within the interior volume of the spindle, and an outer surface of the first gear may be meshed with the plurality of splines to couple the first gear to the spindle. The plate of the bracket may be disposed between the motor and the first gear along the lateral direction.

In a second example aspect, a damping pad may be disposed between the motor and the plate of the bracket along the lateral direction.

In a third example aspect, the distal end portion of each of the first and second legs may include a respective stop. The stop of the first leg may be engageable with the bushing at the first opening and the stop of the second leg may be engageable with the bushing at the second opening to block translation of the motor along the lateral direction out of the interior volume of the spindle.

In a fourth example aspect, the distal end portion of the first leg may include a tab that is engageable with the bushing at the first opening to block translation of the motor against drive gear assembly within the interior volume of the spindle. The stop of the first leg may be positioned at a first side of the bushing, and the tab of the first leg may be positioned at a second side of the bushing. The stop of the first leg may be spaced from the tab of the first leg by a distance along the lateral direction, and the distance may be selected such that the motor is moveable along the lateral direction within the spindle.

In a fifth example aspect, the motor driven spindle assembly may further include a first damping sleeve and a second damping sleeve. The first damping sleeve may be disposed within the first opening of the bushing between the distal end portion of the first leg and the bushing. The second damping sleeve may be disposed within the second opening of the bushing between the distal end portion of the second leg and the bushing.

In a sixth example aspect, the bracket may be a metal bracket, and the first and second legs may be bent relative the plate in order to form the metal bracket.

In a seventh example aspect, the bracket may be U-shaped, and the motor may be positioned between the first and second legs of the bracket.

In an eighth example aspect, a dispenser may include a housing, a roll holder disposed within the housing, and the motor driven spindle assembly disposed within the housing. The motor driven spindle assembly may be operable to dispenser paper on the roll holder from the housing. The bushing may be fixed to the housing.

Each of the example aspects recited above may be combined with one or more of the other example aspects recited above in certain embodiments. For instance, all of the eight example aspects recited above may be combined with one another in some embodiments. As another example, any combination of two, three, four, five, or more of the eight example aspects recited above may be combined in other embodiments. Thus, the example aspects recited above may be utilized in combination with one another in some example embodiments. Alternatively, the example aspects recited above may be individually implemented in other example embodiments. Accordingly, it will be understood that various example embodiments may be realized utilizing the example aspects recited above.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures.

Figure 1:
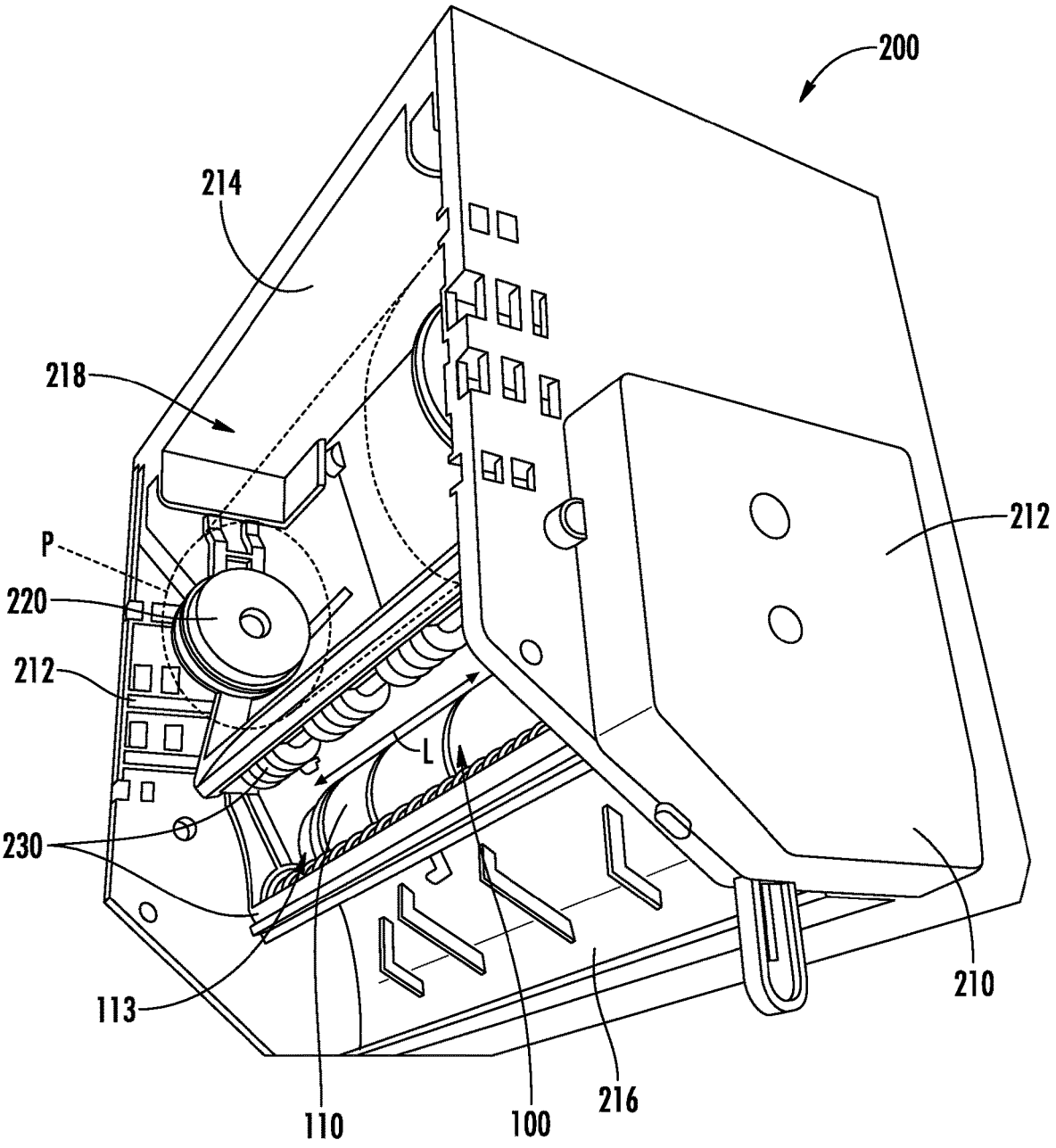
FIG. 1 is a perspective view of a dispenser with a motor driven spindle assembly according to an example embodiment of the present disclosure.
Figure 2:
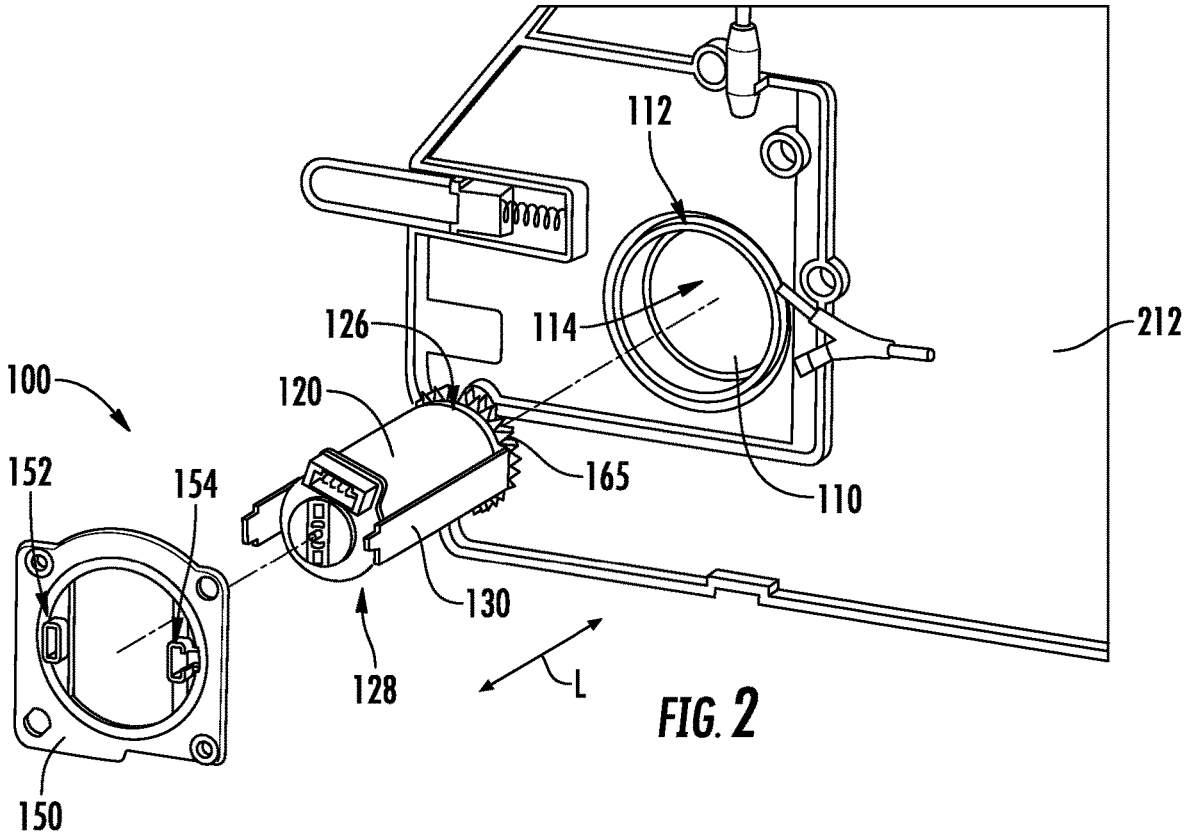
FIG. 2 is a partially exploded view of the example motor driven spindle assembly of FIG. 1.
Figure 3:
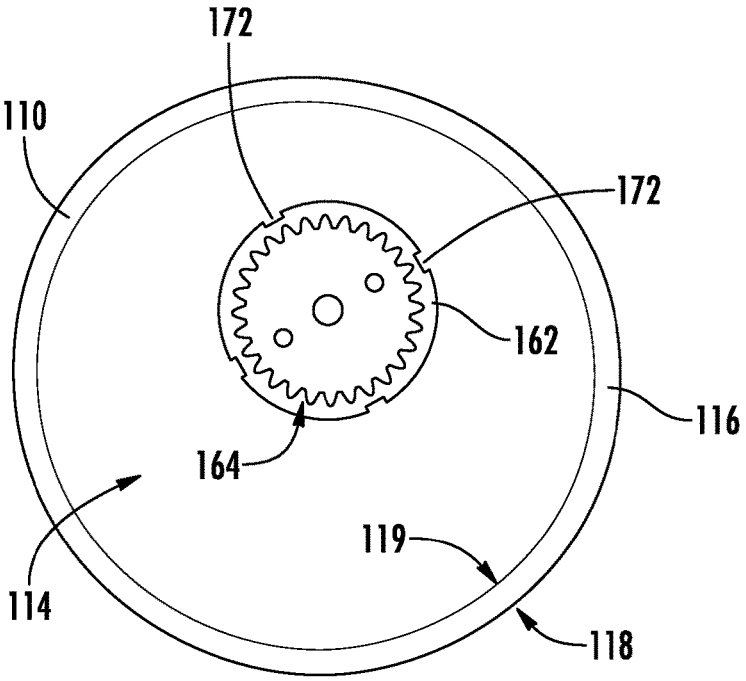
FIG. 3 shows an interior volume of a spindle of the example motor driven spindle assembly of FIG. 1.
Figure 4:
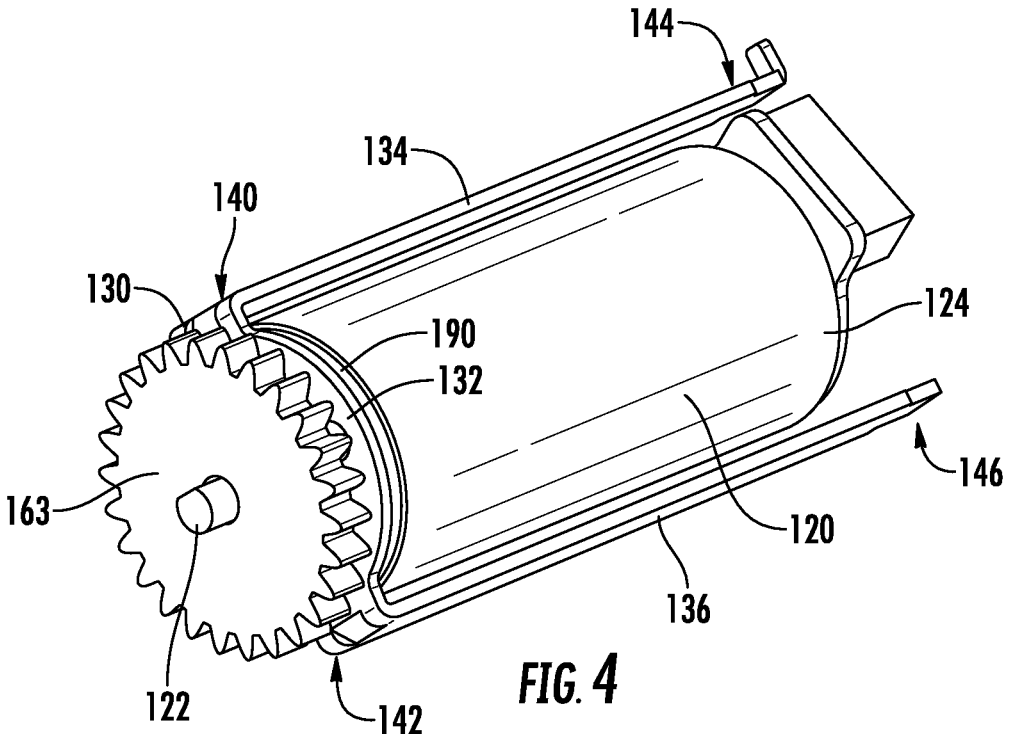
FIG. 4 is a perspective view of certain components of the example motor driven spindle assembly of FIG. 1.
Figure 5:
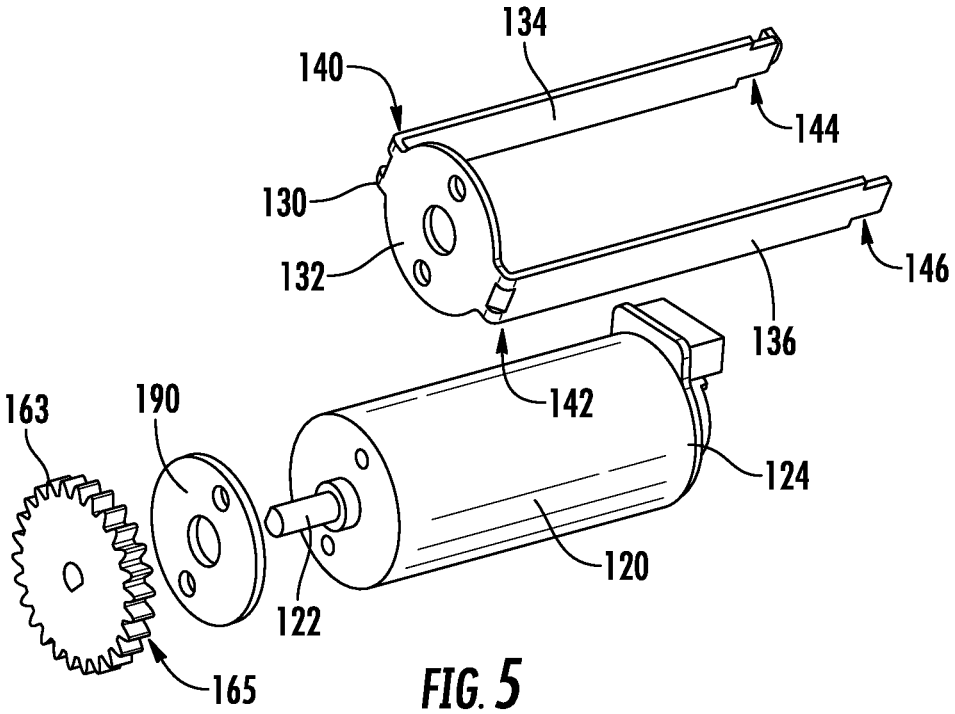
FIG. 5 is an exploded view of the components of FIG. 4.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Example embodiments of the present disclosure are directed to a motor driven spindle assembly for a dispenser. The motor driven spindle assembly includes a spindle and a motor disposed within an interior of the spindle. The motor is operable to rotate the spindle. A bracket supports the motor within the spindle. Legs of the bracket may be slidable on a bushing such that the motor is axially movable relative to the spindle. Thus, the bracket may allow the motor to "float" axially within the spindle, and the bracket may advantageously reduce interference between the motor and the spindle, e.g., relative to known brackets that push the motor against the spindle.

With reference to FIG. 1, a motor driven spindle assembly 100 according to an example embodiment of the present subject matter is shown disposed within a dispenser 200. However, while described below in context of dispenser 200, it will be understood that motor driven spindle assembly 100 may be used in or within any suitably dispenser in alternative example embodiments. The particular arrangement of dispenser 200 is provided by way of example. Moreover, the components and operation of known dispensers will be well understood by those of skill in the art and are not described in great detail herein for the sake of brevity.

Dispenser 200 includes a housing 210. Housing 210 includes a pair of sidewalls 212, a top wall 214, and a bottom wall 216. Sidewalls 212 are spaced apart from each other, e.g., along a lateral direction L. Housing 210 defines an interior 218. Interior 218 of housing 210 may be defined between sidewalls 212, e.g., along the lateral direction L, and/or between top and bottom walls 214, 216, e.g., along a vertical direction.

Various components of dispenser 200 are positioned within interior 218. For example, dispenser 200 includes a roll holder 220 and paper guide rollers 230 within interior 218. A paper roll P may be mounted to roll holder 220 within interior 218. The paper roll P may be rotatable on roll holder 220. Thus, e.g., during operation of dispenser 200, the paper roll P may rotate on roll holder 220 to allow the free end of paper on paper roll P to be dispensed out of dispenser 200, e.g., proximate bottom wall 216. The free end of the paper on paper roll P may be guided through interior 218 by paper guide rollers 230. For instance, the free end of the paper on paper roll P may turn on paper guide rollers 230 as the free end of the paper on paper roll P moves out of dispenser 200.

Motor driven spindle assembly 100 is operable to drive movement of the free end of the paper on paper roll P. For instance, motor driven spindle assembly 100 may be positioned within interior 218, e.g., between sidewalls 212. Moreover, motor driven spindle assembly 100 may extend between and be rotatably supported on sidewalls 212. The free end of the paper on paper roll P may pass between motor driven spindle assembly 100 and one or more guide rollers 230. For example, the one or more guide rollers 230 may be biased towards motor driven spindle assembly 100 to clamp or compress the free end of the paper on paper roll P between motor driven spindle assembly 100 and the one or more guide rollers 230. Thus, motor driven spindle assembly 100 may drive movement of the free end of the paper on paper roll P out of dispenser 200 when motor driven spindle assembly 100 rotates.

Various aspects of motor driven spindle assembly 100 are described in greater detail below in the context of FIGS. 2 through 10. Motor driven spindle assembly 100 includes a spindle 110 that extends longitudinally between a first end portion 112 and a second end portion 113, e.g., along the lateral direction L. The spindle 110 is rotatable about an axis X, e.g., that is parallel to the lateral direction L. Spindle 110 may be rotatably supported on sidewalls 212 of housing 210. For instance, first end portion 112 of spindle 110 may be positioned at and rotatably supported on a first one of sidewalls 212, and second end portion 113 of spindle 110 may be positioned at and rotatably supported on a second, opposite one of sidewalls 212. Thus, spindle 110 may extend across interior 218, e.g., along the lateral direction L, between sidewalls 212. Spindle 110 may be cylindrical (e.g., and thus have a cylindrical wall 116 that extends between first and second end portions 112, 113) and have elastic grips on an outer surface 118 of the spindle 110 to assist with transferring rotation of spindle 110 to paper on paper roll P.

Spindle 110 defines an interior volume 114, e.g., at first end portion 112 of spindle 110. As an example, spindle 110 may define an opening 115 at first end portion 112 via which interior volume 114 is accessible. Thus, interior volume 114 may be open at first end portion 112. Conversely, spindle 110 may include an inner wall 117 positioned within interior volume 114 opposite opening 115. Thus, interior volume 114 may be defined between opening 115 and inner wall 117, e.g., along the lateral direction L, within spindle 110. As discussed in greater detail below, various components of motor driven spindle assembly 100 may be disposed within interior volume 114 and thus within spindle 110.

Motor driven spindle assembly 100 also includes a motor 120. Motor 120 is disposed within interior volume 114 of spindle 110. Thus, motor 120 is positioned within spindle 110. In such a manner, motor driven spindle assembly 100 may advantageously occupy less space within dispenser 200 relative to positioning motor 120 outside of spindle 110. Other advantages of motor driven spindle assembly 100 include operating sound reduction and protection of motor 120 and a drive gear assembly 160 within spindle 110 from paper dust.

Motor 120 is operable to rotate spindle 110 about the axis X. Thus, motor 120 is coupled to spindle 110 such that motor 120 is operable to drive rotation of spindle 110. For example, motor driven spindle assembly 100 may include a drive gear assembly 160. Drive gear assembly 160 may include a first gear 162 and a second gear 163. First gear 162 may be disposed within interior volume 114 of spindle 110 and may be coupled to spindle 100. For example, spindle 110 may include a plurality of splines 172 disposed within interior volume 114 of spindle 110, e.g., at an inner surface 119 of spindle 110 that faces interior volume 114. An outer surface of first gear 162 may be meshed with splines 172 to couple first gear 162 to spindle 110. In particular, splines 172 may extend radially from inner surface 119 into interior volume 114, and outer surface of first gear 162 may be shaped to complement splines 172 and/or such that interference between first gear 162 and splines 172 blocks relative rotation between first gear 162 and spindle 110. Thus, first gear 162 may be fixed to spindle 110 within interior volume 114. First gear 162 may be formed with a two-shot molding process, e.g., with a thermoplastic elastomer (TPE) overmold that engages second gear 163, e.g., in order to reduce operating noise of drive gear assembly 160 at the interface between first and second gears 162, 163. Thus, e.g., first gear 162 may be a dual material gear with a first, harder material forming a web 166 and/or a ring 168 of first gear 162 and with a second, softer material forming teeth 164 of first gear 162.

Second gear 163 may be meshed with first gear 162. For example, first gear 162 may include a plurality of teeth 164 extending radially inward, and second gear 163 may include a plurality of teeth 165 extending radially outward. Teeth 164 of first gear 162 may be meshed with teeth 165 of second gear 163, e.g., by inserting second gear 163 into first gear 162. Second gear 163 may also be coupled a rotor 122 of motor 120. For example, second gear 163 may be positioned on and fixed to rotor 122. During operation of motor 120, rotation of rotor 122 may thus rotate second gear 163, first gear 162, and spindle 110 due to the connection therebetween.

As may be seen from the above, spindle 110 is rotatable with motor 110, which is disposed within spindle 110. Motor driven spindle assembly 100 also include features for mounting motor 120 within interior volume 114. In particular, motor driven spindle assembly 100 includes a bracket 130 for supporting motor 120 within spindle 110. Bracket 130 includes a plate 132, a first leg 134, and a second leg 136. Plate 132 of bracket 130 may be positioned within interior volume 114 of spindle 110. For example, motor 120 may extend longitudinally between a first end portion 126 and a second end portion 128, e.g., along the lateral direction L. Plate 132 may be positioned proximate first end portion 126 of motor 120 within interior volume 114. Moreover, rotor 122 of motor 120 may extend through plate 132, e.g., along the lateral direction L, to first gear 163. A stator 124 of motor 120 may be fixed to plate 132. For example, fasteners may extend through plate 132 into stator 124 couple motor 120 to plate 132. Plate 139 may also be disposed between motor 120 and first gear 162, e.g., along the lateral direction L.

First and second legs 134, 136 may be positioned at opposite each other about motor 120 and/or on plate 132, and motor 120 may be positioned between first and second legs 134, 136. In addition, each of first and second legs 134, 136 may have a respective proximal end portion 140, 144 and a respective distal end portion 142, 146. In particular, first leg 134 may extend between proximal end portion 140 and distal end portion 142, e.g., along the lateral direction L, and second leg 136 may extend between proximal end portion 144 and distal end portion 146, e.g., along the lateral direction L. Proximal end portion 140, 144 of first and second legs 134, 136 may be positioned at and mounted to plate 132. Conversely, first and second legs 134, 136 may extend away from plate 132, e.g., along the lateral direction L, to distal end portion 142, 146 of first and second legs 134, 136. Proximal end portion 140, 144 of first and second legs 134, 136 may be positioned at or proximate first end portion 126 of motor 120, and distal end portion 142, 146 of first and second legs 134, 136 may be positioned at or proximate second end portion 128 of motor 120.

Bracket 130 may be a metal bracket in certain example embodiments. In addition, first and second legs 134, 136 may be bent relative plate 132 in order to form bracket 130. For example, bracket 130 may be U-shaped and formed by bending a piece of metal to angle first and second legs 134, 136 relative to plate 132.

A bushing 150 may be positioned proximate second end portion 128 of motor 120. In addition, bushing 150 may be positioned on housing 210 at opening 115 of spindle 110. Bushing 150 may be fixed to housing 210, e.g., such that bushing 150 is not rotatable with spindle 110 by motor 120. For example, bushing 150 may be fastened, heat staked, ultrasonically welded, etc. to housing 210, e.g., the one of sidewalls 212 proximate first end portion 112 of spindle 110.

Bracket 130 is mounted to bushing 150. In particular, bushing 130 defines a first opening 152 and a second opening 154, e.g., on opposite sides of bushing 150. Distal end portion 142 of first leg 134 is positioned within first opening 152 of bushing 150, and distal end portion 142 of first leg 134 is slidable within first opening 152, e.g., along the lateral direction L. Distal end portion 146 of second leg 136 is positioned within second opening 154 of bushing 150, and distal end portion 146 of second leg 136 is slidable within second opening 154, e.g., along the lateral direction L. By allowing first and second legs 136 to slide relative to bushing 150, e.g., and thus housing 210, motor 120 may translate, e.g., along the lateral direction L, relative to spindle 110 within interior volume 114. Such relative movement between spindle 110 and motor 120 may advantageously avoid interference with operation of motor 120 due to motor 120 being compressed against spindle 110.

Figure 9:
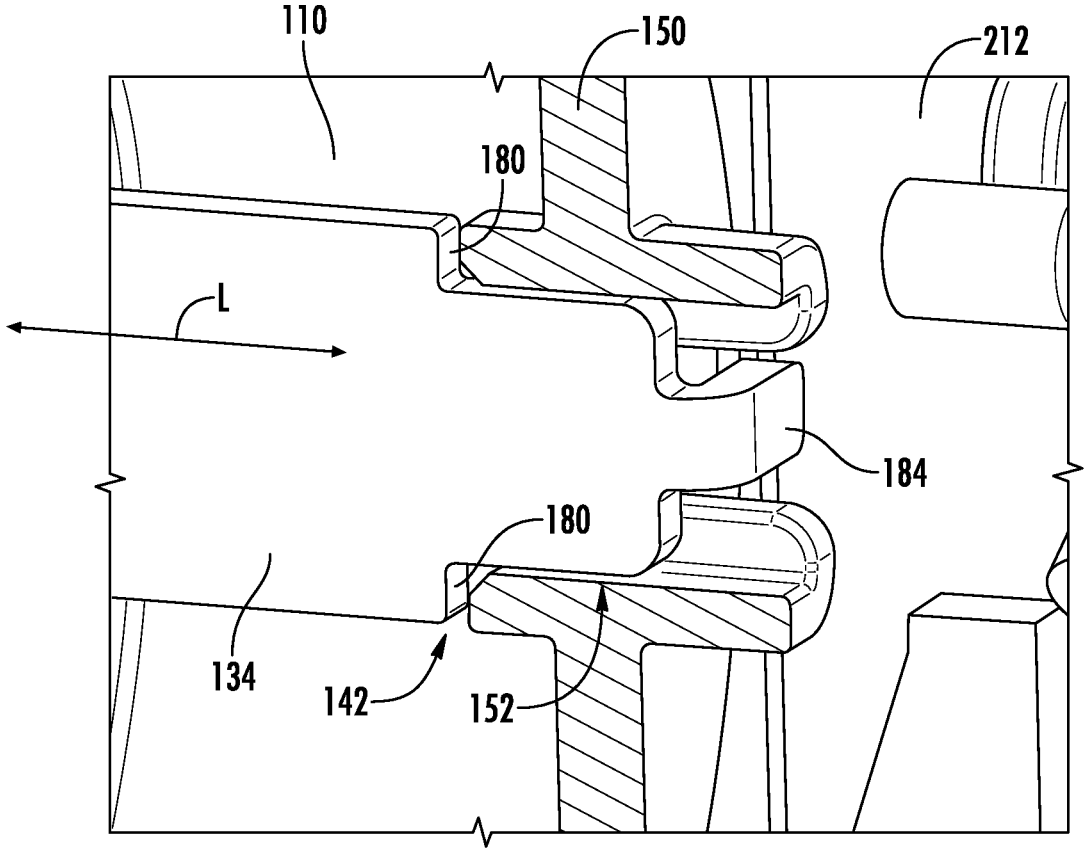
FIG. 9 is a partial view of an interface between a leg of a bracket and a bushing of the example motor driven spindle assembly of FIG. 1.
Figure 10:
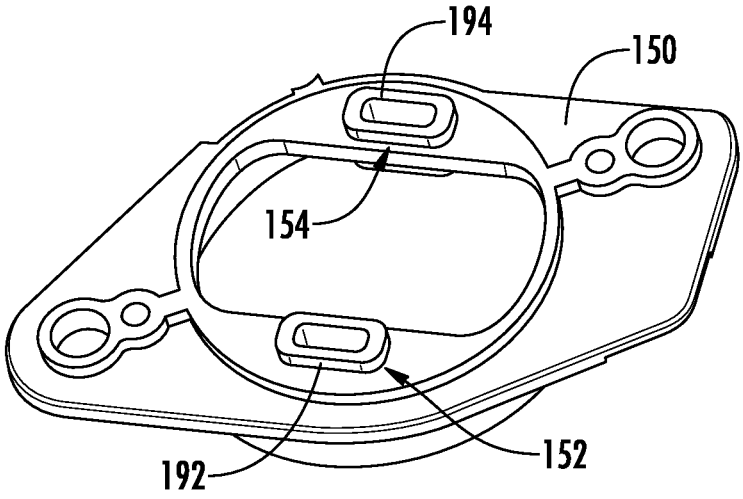
FIG. 10 is a perspective view of a bushing for the example motor driven spindle assembly of FIG. 1.

To assist with mounting motor 120 to spindle 110 with bracket 130, distal end portion 142, 146 of each of first and second legs 134, 136 may include a respective at least one stop 180. Although only distal end portion 142 of first leg 134 is shown in FIG. 9, it will be understood that distal end portion 146 of second leg 136 may be formed in the same or similar manner, e.g., with or without hook 184, to distal end portion 142 of first leg 134 show in FIG. 9. As shown in FIG. 9, first leg 134 may include two stops 180, each positioned on a respective edge of first leg 134.

Stop 180 of first leg 134 may be engageable with bushing 150 at first opening 152, and stop 180 of second leg 136 may be engageable with bushing 150 at second opening 154. Stops 180 may impact against bushing 150 to block translation of motor 120, e.g., along the lateral direction L, out of interior volume 114 of spindle 110. For example, a width of first leg 134 at stop 180 may be greater than a corresponding width of first opening 152 such that first leg 134 at stop 180 interferes with bushing 150 and cannot enter first opening 152. Distal end portion 142 of first leg 134 may also include a hook 184. An electrical lead, such as a wire, may be soldered or otherwise electrically coupled to hook 184, e.g., in order to assist with grounding bracket 130 and/or motor 120 within spindle 110.

Figure 6:
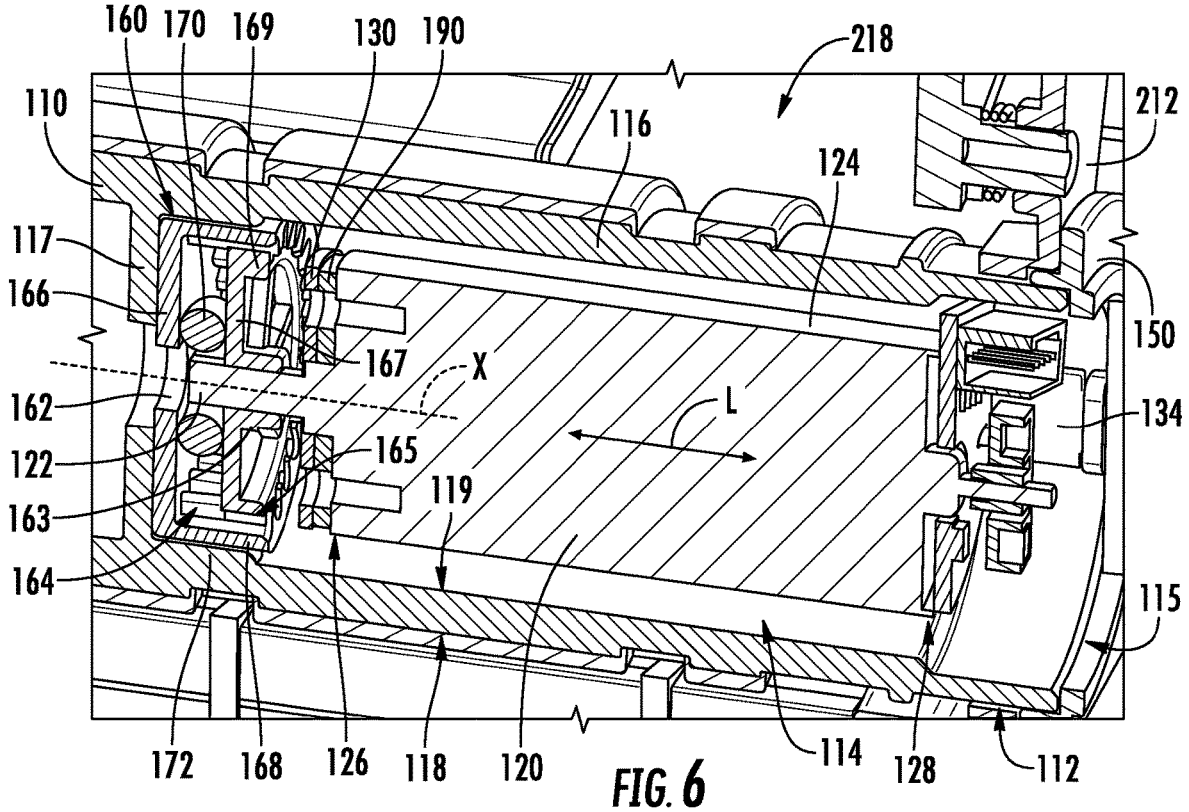
FIG. 6 is a perspective, partial section view of the example motor driven spindle assembly of FIG. 1.
Figure 7:
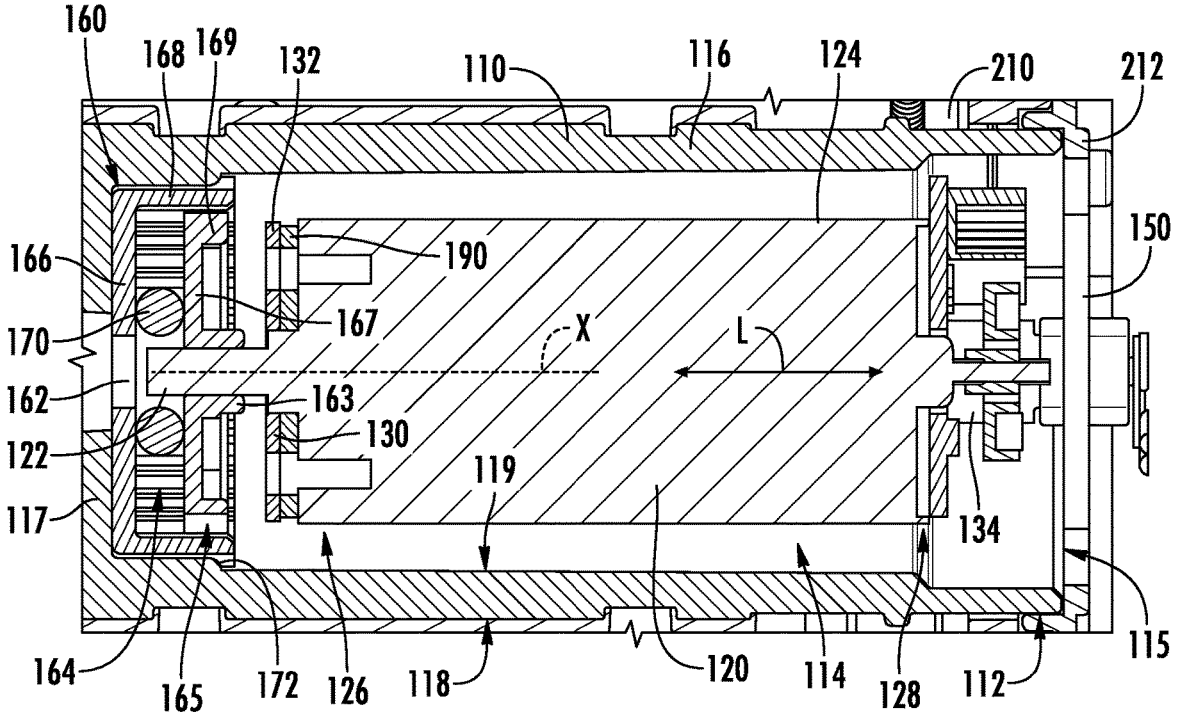
FIG. 7 is an elevation, partial section view of the example motor driven spindle assembly of FIG. 1.
Figure 8:
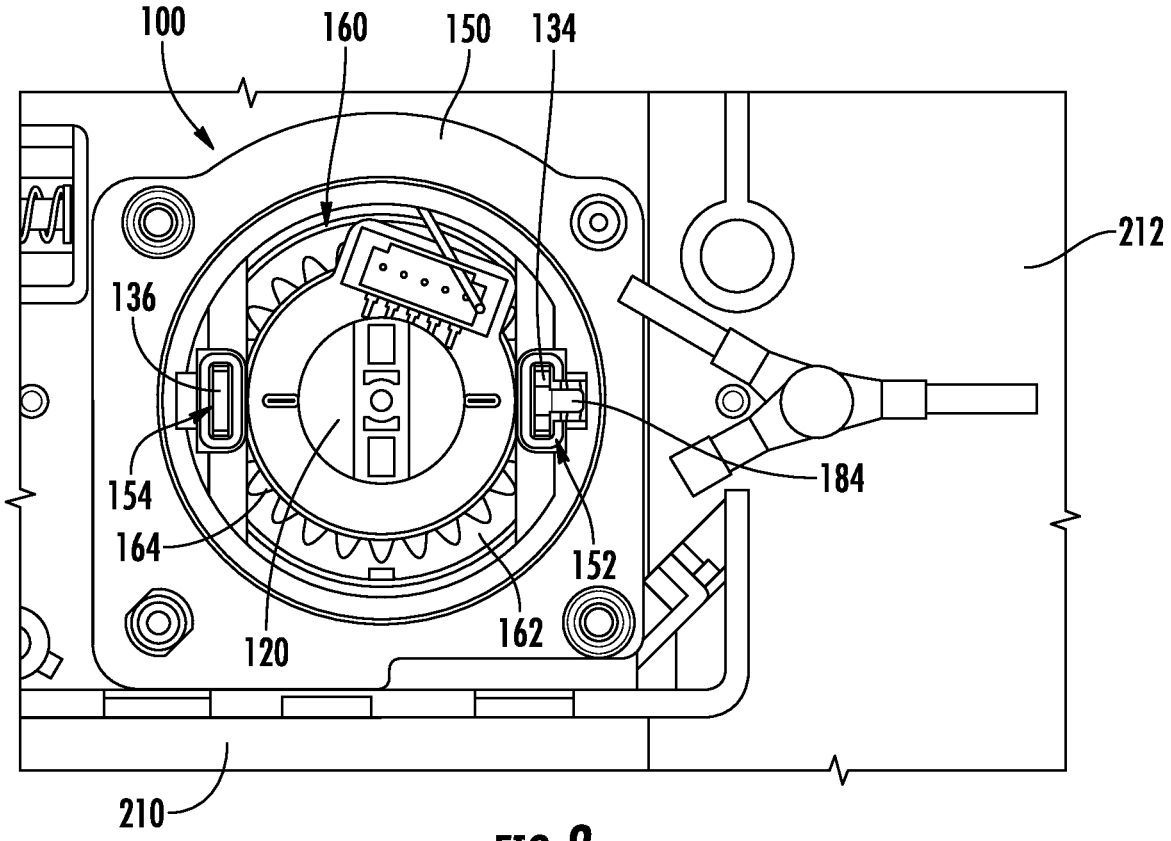
FIG. 8 is a partial elevation view of the example motor driven spindle assembly of FIG. 1.

As shown in FIGS. 6 and 7, first gear 162 may include a web 166 that extends radially inward from a ring 168 of first gear 162. The teeth 164 of first gear 162 may be disposed on ring 168 of first gear 162, e.g., and extend radially inward from ring 168 of first gear 162. Second gear 163 may include a web 167 that extends radially inward from a ring 169 of second gear 163. The teeth 165 of second gear 163 may be disposed on ring 169 of second gear 163, e.g., and extend radially outward from ring 169 of second gear 163. A spacer 170 may be disposed and/or extend between web 166 of first gear 162 and web 167 of second gear 163, e.g., along the lateral direction L. Spacer 170 may thus block web 166 of first gear 162 from impacting against web 167 of second gear 163. Spacer 170 may be constructed of or with a suitable thermoset or thermoplastic, e.g., selected for a suitable elasticity. Rotor 122 of motor 120 may extend at least partially into spacer 170, e.g., along the lateral direction L. Thus, spacer 170 may be annular, such as an O-ring. Motor 120 may float within spindle 110 between spacer 170 and bushing 150. As an example, motor 120 may float by no less than one-tenth of a millimeter (0.1 mm) and no greater than five millimeters (5 mm) within spindle 110 between spacer 170 and bushing 150. In certain example embodiments, motor 120 may float by about half a millimeter (0.5 mm) within spindle 110 between spacer 170 and bushing 150.

Motor driven spindle assembly 100 may also include features for reducing an operating noise of motor driven spindle assembly 100, e.g., while motor 120 rotates spindle 110. For example, a damping pad 190 may be disposed between motor 120 and plate 132, e.g., along the lateral direction L. Damping pad 190 may be configured for reducing or damping vibration transfer from motor 120 to plate 132. Damping pad 190 may have a shape, e.g., in a plane that is perpendicular to the lateral direction L, that is complementary to the corresponding shape of the motor 120 and/or plate 130. Thus, e.g., damping pad 190 may be circular. Damping pad 190 may be constructed of or with a suitable thermoset or thermoplastic, e.g., selected for a suitable elasticity and/or damping of vibrations between motor 120 and plate 132.

Motor driven spindle assembly 100 may also include a first damping sleeve 192 and a second damping sleeve 194. First damping sleeve 192 may be disposed within first opening 152 of bushing 150, e.g., between distal end portion 142 of first leg 134 and bushing 150. First damping sleeve 192 may be configured for reducing or damping vibration transfer from first leg 134 to bushing 150. Second damping sleeve 194 may be disposed within second opening 154 of bushing 150, e.g., between distal end portion 146 of second leg 136 and bushing 150. Second damping sleeve 194 may be configured for reducing or damping vibration transfer from second leg 136 to bushing 150. First and second damping sleeves 192, 194 may be constructed of or with a suitable thermoset or thermoplastic, e.g., selected for a suitable elasticity and/or damping of vibrations between bracket 130 and bushing 150.

Figure 11:
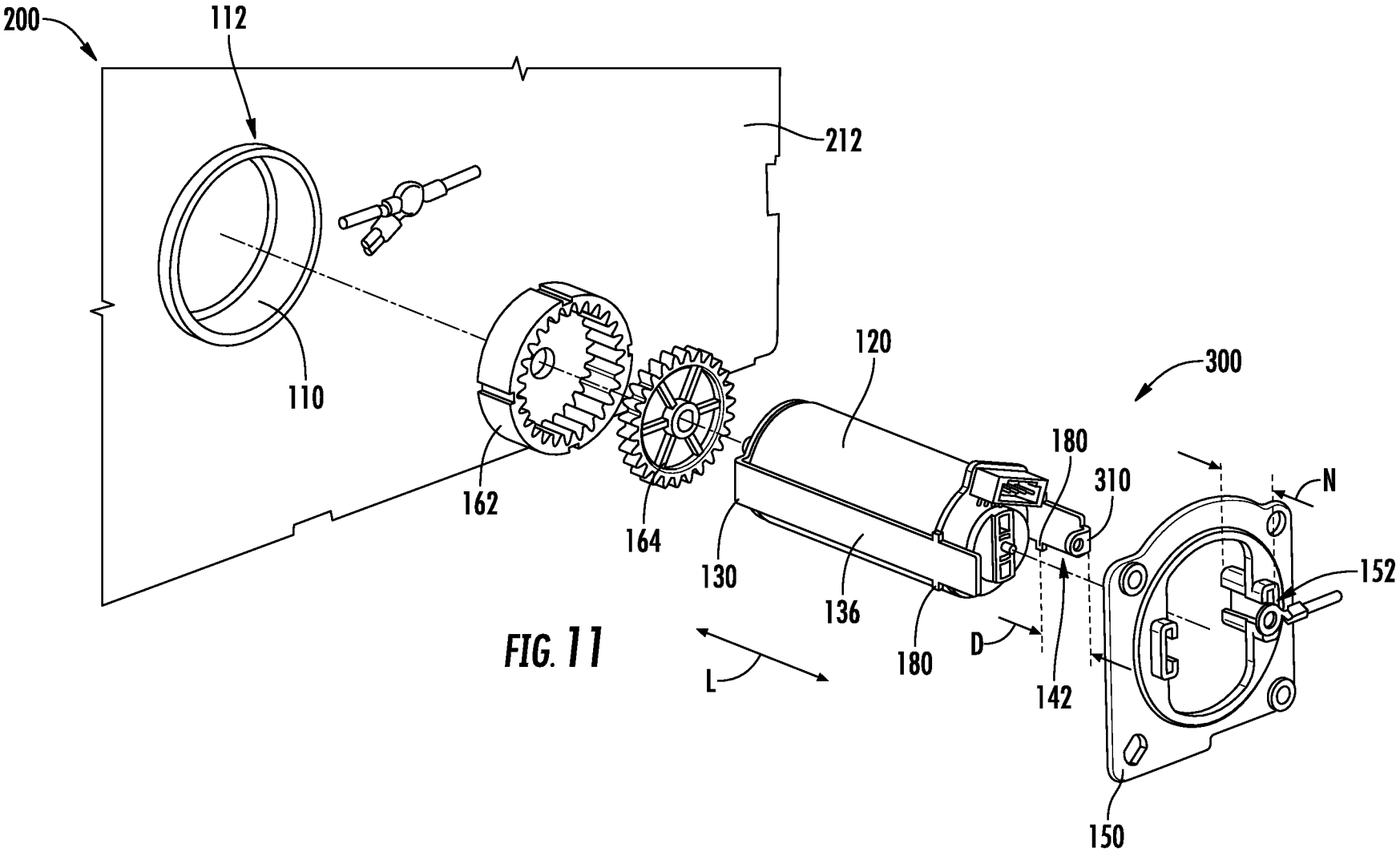
FIG. 11 is a partially exploded view of a motor driven spindle assembly according to another example embodiment of the present disclosure.
Figure 12:
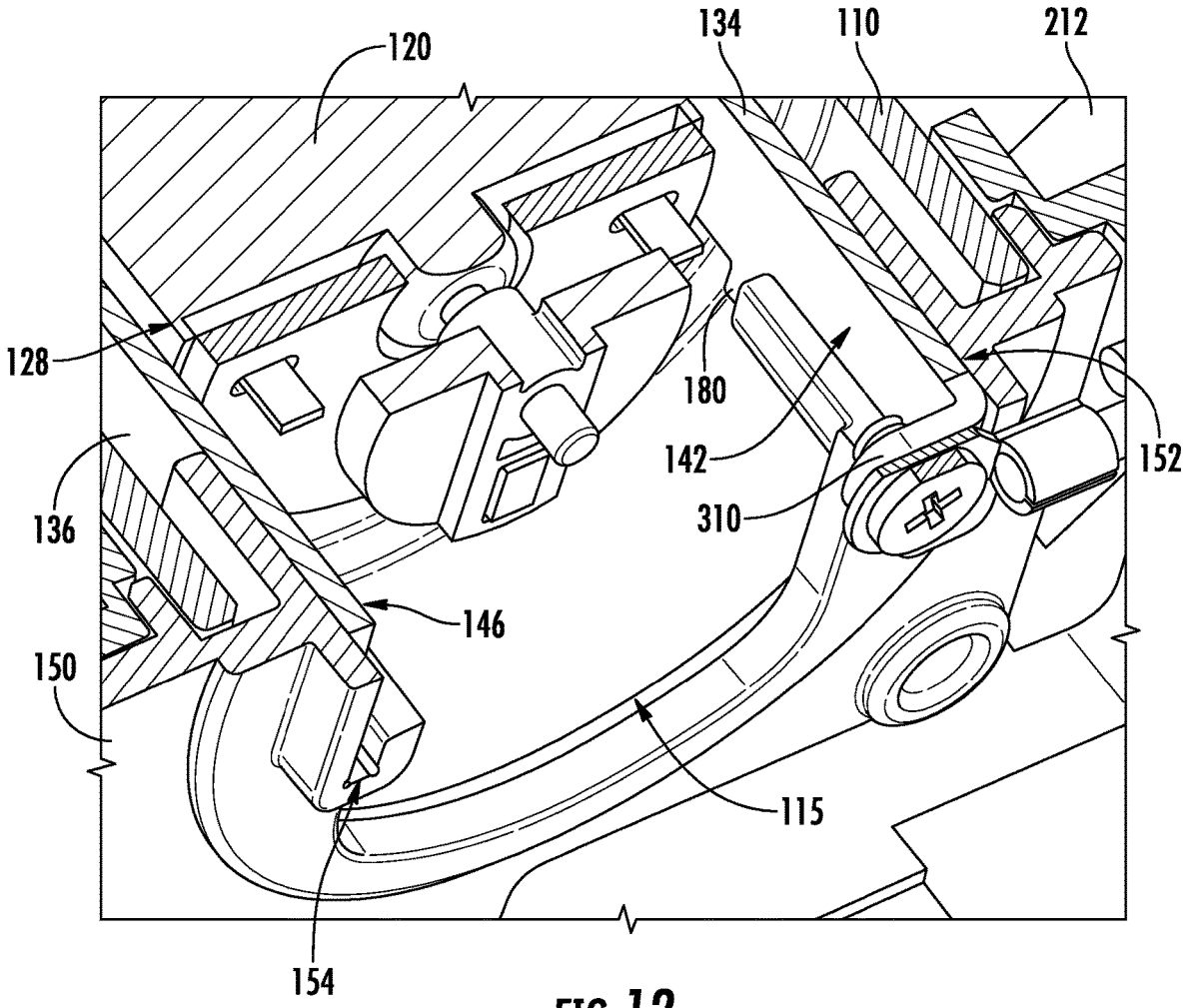
FIG. 12 is an elevation, partial section view of the example motor driven spindle assembly of FIG. 11.

FIGS. 11 and 12 show a motor driven spindle assembly 300 according to another example embodiment of the present subject matter. Motor driven spindle assembly 300 includes numerous common components and functions in the same or similar manner to that described above for motor driven spindle assembly 100 shown in FIGS. 1 through 10. Thus, reference is made to the above description of motor driven spindle assembly 100, which is not repeated to describe motor driven spindle assembly 300 for the sake of brevity. The differences between motor driven spindle assembly 300 and motor driven spindle assembly 100 are described in greater detail below.

Various aspects of motor driven spindle assembly 300 are described in greater detail below in the context of FIGS. 11 and 12. As shown, stops 180 of first and second legs 134, 136 may be formed as shoulders and/or projections on first and second legs 134, 136. Distal end portion 142 of first leg 134 may also include a tab 310, e.g., rather than hook 184. An electrical lead, such as a wire, may be fastened or otherwise electrically coupled to tab 310, e.g., in order to assist with grounding bracket 130 and/or motor 120 within spindle 110. Tab 310 may be positioned opposite stop 180 of first leg 134 about bushing 150, and tab 310 may be engageable with bushing 150 at first opening 152. For example, tab 310 may impact against bushing 150 and block translation of motor 120, e.g., along the lateral direction L, against drive gear assembly 160 within interior volume 114 of spindle 110. Spacer 170 within spindle 110 may be omitted in motor driven spindle assembly 300.

Stop 180 of first leg 134 may be spaced from tab 310 of first leg 134 by a distance D, e.g., along the lateral direction L. Similarly, first opening 152 may have a length N, e.g., along the lateral direction L. The distance D and the length N may be selected such that motor 120 is moveable within interior volume 114, e.g., along the lateral direction L, by about a difference F between the distance D and the length N while still being supported by bracket 130. Thus, motor 120 may float by about the difference F on bracket 130 within spindle 110. The difference F may be a suitable spacing. For example, the difference F may be no less than one-tenth of a millimeter (0.1 mm) and no greater than five millimeters (5 mm). In certain example embodiments, the distance D may be about half a millimeter (0.5 mm).

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

Example Embodiments

First example embodiment: A motor driven spindle assembly (100) for a dispenser, comprising: a spindle (110) rotatable about an axis (X), the spindle (110) extending longitudinally between a first end portion (112) of the spindle (110) and a second end portion (113) of the spindle (110), the spindle (110) defining an interior volume (114) within the spindle (110) at the first end portion (112) of the spindle (110); a motor (120) disposed within the interior volume (114) of the spindle (110), the motor (120) operable to rotate the spindle (110) about the axis (X); a bracket (130) for supporting the motor (120) within the spindle (110), the bracket (130) comprising a plate (132), a first leg (134), and a second leg (136), the plate (132) of the bracket (130) positioned within the interior volume (114) of the spindle (110) proximate a first end portion (126) of the motor (120), each of the first and second legs (134, 136) having a respective proximal end portion (140, 144) and a respective distal end portion (142, 146), the proximal end portions (140, 144) of the first and second legs (134, 136) positioned at the plate (132), each of the first and second legs (134, 136) extending away from the plate (132) to the distal end portions (142, 146) of the first and second legs (134, 136); and a bushing (150) positioned proximate a second end portion (128) of the motor (120), the bushing (150) defining a first opening (152) and a second opening (154), the distal end portion (142) of the first leg (134) positioned within the first opening (152) of the bushing (150) such that the distal end portion (142) of the first leg (134) is slidable within the first opening (152) along a lateral direction (L), the distal end portion (146) of the second leg (136) positioned within the second opening (154) of the bushing (150) such that the distal end portion (146) of the second leg (136) is slidable within the second opening (154) along the lateral direction (L), the lateral direction (L) being parallel to the axis (X).

Second example embodiment: The motor driven spindle assembly (100) of the first example embodiment, further comprising a drive gear assembly (160) comprising a first gear (162) and a second gear (163), the first gear (162) disposed within the interior volume (114) of the spindle (110) and coupled to the spindle (110), the second gear (163) meshed with the first gear (162) and coupled a rotor (122) of the motor (120).

Third example embodiment: The motor driven spindle assembly (100) of the second example embodiment, wherein the first gear (162) comprises a plurality of teeth (164) extending radially inward, the second gear (163) comprises a plurality of teeth (165) extending radially outward, and the plurality of teeth (164) of the first gear (162) are meshed with the plurality of teeth (165) of the second gear (163).

Fourth example embodiment: The motor driven spindle assembly (100) of the third example embodiment, wherein the first gear (162) comprises a web (166) that extends radially inward from a ring (168) of the first gear (162), the plurality of teeth (164) of the first gear (162) are disposed on the ring (168) of the first gear (162), the second gear (163) comprises a web (167) that extends radially inward from a ring (169) of the second gear (163), the plurality of teeth (165) of the second gear (163) are disposed on the ring (169) of the second gear (163), and a spacer (170) is disposed between the web (166) of the first gear (162) and the web (167) of the second gear (163).

Fifth example embodiment: The motor driven spindle assembly (100) of the fourth example embodiment, wherein the rotor (122) of the motor (120) extends at least partially into the spacer (170).

Sixth example embodiment: The motor driven spindle assembly (100) of the second example embodiment, wherein the spindle (110) comprises a plurality of splines (172) disposed within the interior volume (114) of the spindle (110), and an outer surface of the first gear (162) is meshed with the plurality of splines (172) to couple the first gear (162) to the spindle (110).

Seventh example embodiment: The motor driven spindle assembly (100) of the second example embodiment, wherein the plate (132) of the bracket (130) is disposed between the motor (120) and the first gear (162) along the lateral direction (L).

Eighth example embodiment: The motor driven spindle assembly (100) of any one of the first through seventh example embodiments, further comprising a damping pad (190) disposed between the motor (120) and the plate (132) of the bracket (130) along the lateral direction (L).

Ninth example embodiment: The motor driven spindle assembly (100) of any one of the first through eighth example embodiments, wherein the distal end portions (140, 144) of each of the first and second legs (134, 136) comprises a respective stop (180, 182), the stop (180) of the first leg (134) engageable with the bushing (150) at the first opening (152) and the stop (182) of the second leg (136) engageable with the bushing (150) at the first and second openings (152, 154) to block translation of the motor (120) along the lateral direction (L) out of the interior volume (114) of the spindle (110).

Tenth example embodiment: The motor driven spindle assembly (100) of the ninth example embodiment, wherein the distal end portion (142) of the first leg (134) comprises a tab (310) that is engageable with the bushing (150) at the first opening (152) to block translation of the motor (120) against the drive gear assembly (160) within the interior volume (114) of the spindle (110).

Eleventh example embodiment: The motor driven spindle assembly (100) of the tenth example embodiment, wherein the stop (180) of the first leg (134) is positioned at a first side of the bushing (150), and the tab (310) of the first leg (134) is positioned at a second side of the bushing (150).

Twelfth example embodiment: The motor driven spindle assembly (100) of the eleventh example embodiment, wherein the stop (180) of the first leg (134) is spaced from the tab (310) of the first leg (134) by a distance (D) along the lateral direction (L), and the distance (D) is selected such that the motor (120) is moveable along the lateral direction (L) within the spindle (110).

Thirteenth example embodiment: The motor driven spindle assembly (100) of any one of the first through twelfth example embodiments, further comprising a first damping sleeve (192) and a second damping sleeve (194), the first damping sleeve (192) disposed within the first opening (152) of the bushing (150) between the distal end portion (142) of the first leg (134) and the bushing (150), the second damping sleeve (194) disposed within the second opening (154) of the bushing (150) between the distal end portion (146) of the second leg (136) and the bushing (150).

Fourteenth example embodiment: The motor driven spindle assembly (100) of any one of the first through thirteenth example embodiments, wherein the bracket (130) is a metal bracket, and the first and second legs (134, 136) are bent relative the plate (132) in order to form the metal bracket.

Fifteenth example embodiment: The motor driven spindle assembly (100) of any one of the first through fourteenth example embodiments, wherein the bracket (130) is U-shaped, and the motor (120) is positioned between the first and second legs (134, 136) of the bracket (130).

Sixteenth example embodiment: A dispenser (200), comprising: a housing (210); a roll holder (220) disposed within the housing (210); and the motor driven spindle assembly (100) of any one of the first through fifteenth example embodiments, disposed within the housing (210), the motor driven spindle assembly (100) operable to dispenser paper on the roll holder (220) from the housing (210).

Seventeenth example embodiment: The dispenser of the sixteenth example embodiment, wherein the bushing (150) is fixed to the housing (210).

REFERENCE CHARACTERS

100 Motor driven spindle assembly
110 Spindle
112 First end portion of spindle
113 Second end portion of spindle
114 Interior volume
115 Opening of spindle
116 Cylindrical wall
117 Inner wall
118 Outer surface of spindle
119 Inner surface of spindle
120 Motor
122 Rotor
124 Stator
126 First end portion of motor
128 Second end portion of motor
130 Bracket
132 Plate
134 First leg
136 Second leg
140 Proximal end portion of first leg
142 Distal end portion of first leg
144 Proximal end portion of second leg
146 Distal end portion of second leg
150 Bushing
152 First opening
154 Second opening
160 Drive gear assembly
162 First gear
163 Second gear
164 Teeth of first gear
165 Teeth of second gear
166 Web of first gear
167 Web of second gear
168 Ring of first gear
169 Ring of second gear
170 Spacer
172 Splines
174 Outer surface of first gear
180 Stop
184 Hook
190 Damping pad
192 First damping sleeve
194 Second damping sleeve
200 Dispenser
210 Housing
212 Sidewalls
214 Top wall
216 Bottom wall
218 Interior
220 Roll holder
230 Paper guide rollers
300 Motor driven spindle assembly
310 Tab
X Axis
L Lateral direction
P Paper roll
D Distance
N Length of opening
F Difference

What is claimed:

1. A motor driven spindle assembly for a dispenser, comprising:

a spindle rotatable about an axis, the spindle extending longitudinally between a first end portion of the spindle and a second end portion of the spindle, the spindle defining an interior volume within the spindle at the first end portion of the spindle;

a motor disposed within the interior volume of the spindle, the motor operable to rotate the spindle about the axis;

a bracket for supporting the motor within the spindle, the bracket comprising a plate, a first leg, and a second leg, the plate of the bracket positioned within the interior volume of the spindle proximate a first end portion of the motor, each of the first and second legs having a respective proximal end portion and a respective distal end portion, the proximal end portion of the first and second legs positioned at the plate, each of the first and second legs extending away from the plate to the distal end portion of the first and second legs; and a bushing positioned proximate a second end portion of the motor, the bushing defining a first opening and a second opening, the distal end portion of the first leg positioned within the first opening of the bushing such that the distal end portion of the first leg is slidable within the first opening along a lateral direction, the distal end portion of the second leg positioned within the second opening of the bushing such that the distal end portion of the second leg is slidable within the second opening along the lateral direction, the lateral direction being parallel to the axis.

2. The motor driven spindle assembly of claim 1, further comprising a drive gear assembly comprising a first gear and a second gear, the first gear disposed within the interior volume of the spindle and coupled to the spindle, the second gear meshed with the first gear and coupled a rotor of the motor.

3. The motor driven spindle assembly of claim 2, wherein the first gear comprises a plurality of teeth extending radially inward, the second gear comprises a plurality of teeth extending radially outward, and the plurality of teeth of the first gear are meshed with the plurality of teeth of the second gear.

4. The motor driven spindle assembly of claim 3, wherein the first gear comprises a web that extends radially inward from a ring of the first gear, the plurality of teeth of the first gear are disposed on the ring of the first gear, the second gear comprises a web that extends radially inward from a ring of the second gear, the plurality of teeth of the second gear are disposed on the ring of the second gear, and a spacer is disposed between the web of the first gear and the web of the second gear.

5. The motor driven spindle assembly of claim 4, wherein the rotor of the motor extends at least partially into the spacer.

6. The motor driven spindle assembly of claim 2, wherein the spindle comprises a plurality of splines disposed within the interior volume of the spindle, and an outer surface of the first gear is meshed with the plurality of splines to couple the first gear to the spindle.

7. The motor driven spindle assembly of claim 2, wherein the plate of the bracket is disposed between the motor and the first gear along the lateral direction.

8. The motor driven spindle assembly of claim 1, further comprising a damping pad disposed between the motor and the plate of the bracket along the lateral direction.

9. The motor driven spindle assembly of claim 1, wherein the distal end portion of each of the first and second legs comprises a respective stop, the stop of the first leg engageable with the bushing at the first opening and the stop of the second leg engageable with the bushing at the second opening to block translation of the motor along the lateral direction out of the interior volume of the spindle.

10. The motor driven spindle assembly of claim 9, wherein the distal end portion of the first leg comprises a tab that is engageable with the bushing at the first opening to block translation of the motor against drive gear assembly within the interior volume of the spindle.

11. The motor driven spindle assembly of claim 10, wherein the stop of the first leg is positioned at a first side of the bushing, and the tab of the first leg is positioned at a second side of the bushing.

12. The motor driven spindle assembly of claim 11, wherein the stop of the first leg is spaced from the tab of the first leg by a distance along the lateral direction, and the distance is selected such that the motor is moveable along the lateral direction within the spindle.

13. The motor driven spindle assembly of claim 1, further comprising a first damping sleeve and a second damping sleeve, the first damping sleeve disposed within the first opening of the bushing between the distal end portion of the first leg and the bushing, the second damping sleeve disposed within the second opening of the bushing between the distal end portion of the second leg and the bushing.

14. The motor driven spindle assembly of claim 1, wherein the bracket is a metal bracket, and the first and second legs are bent relative the plate in order to form the metal bracket.

15. The motor driven spindle assembly of claim 1, wherein the bracket is U-shaped, and the motor is positioned between the first and second legs of the bracket.

16. A dispenser, comprising:

a housing;

a roll holder disposed within the housing; and the motor driven spindle assembly of claim 1 disposed within the housing, the motor driven spindle assembly operable to dispenser paper on the roll holder from the housing.

17. The dispenser of claim 16, wherein the bushing is fixed to the housing.

* * * * *